United States Patent [19]

Cheng

[11] Patent Number: 4,488,375

[45] Date of Patent: Dec. 18, 1984

[54] TOY VEHICLE WITH PIVOTABLE BODY

[75] Inventor: Lap K. Cheng, Kowloon, Hong Kong

[73] Assignee: Hang Tjuk Industrial Col Ltd., Kowloon, Hong Kong

[21] Appl. No.: 423,044

[22] Filed: Sep. 24, 1982

[30] Foreign Application Priority Data

Sep. 29, 1981 [GB] United Kingdom ..... 8129404

[51] Int. Cl.[3] ..... A63H 17/36

[52] U.S. Cl. ..... 446/443; 446/463

[58] Field of Search ..... 46/251, 211, 212, 262, 46/201, 206, 202, 252, 213, 209

[56] References Cited

U.S. PATENT DOCUMENTS

| | | | |
|---|---|---|---|
| 1,855,702 | 4/1932 | Berger | 46/211 |
| 2,713,231 | 7/1955 | Hore | 46/204 X |
| 4,166,338 | 9/1979 | Asano | 46/253 |

FOREIGN PATENT DOCUMENTS

| | | | |
|---|---|---|---|
| 152683 | 1/1952 | Australia | 46/211 |
| 933733 | 9/1955 | Fed. Rep. of Germany | 46/206 |

*Primary Examiner*—Mickey Yu

*Attorney, Agent, or Firm*—Spencer & Frank

[57] ABSTRACT

A toy motor car comprises a body having a bottom cover secured thereto by means of screws and a frame on which the body is pivotally mounted. Back wheels of the car are rotatably mounted to the frame and are adapted to be driven in rotation by a battery powered motor housed in a gear box mounted on the frame. The motor also effects rotation of a pinion and an eccentric cam. A clutch is provided in the gear box for changing the direction of rotation of the back wheels at predetermined intervals and, when the car is travelling in a first direction, the cam engages a cam follower which is pivotal with respect to the frame to effect rocking of the body relative to the frame. When the direction of rotation of the back wheels changes, the cam is disengaged from the cam follower and the pinion engages a rack of a lever thereby turning front wheels of the car.

5 Claims, 2 Drawing Figures

TOY VEHICLE WITH PIVOTABLE BODY

BACKGROUND OF THE INVENTION

This invention relates to improvements in or relating to toy vehicles.

Toy motor vehicles have been proposed which can be driven by an electrically powered motor, clockwork or the like and can perform a number of functions such as reversing, or turning on meeting an obstacle. Toy motor vehicles have also been proposed which can be caused to turn, reverse and so on by remote control, for example using a radio transmitter and receiver.

OBJECT OF THE INVENTION

It is an object of the present invention to enable the provision of a novel toy motor vehicle.

SUMMARY OF THE INVENTION

According to the present invention there is provided a toy vehicle, which comprises a frame, a body, the body being pivotally mounted on the frame, and means for effecting movement of the vehicle and for effecting pivotal movement of the body relative to the frame.

BRIEF DESCRIPTION OF THE DRAWINGS

For a better understanding of the present invention, and to show how the same may be put into effect, reference will now be made, by way of example, to the accompanying drawings, in which.

DESCRIPTION OF PREFERRED EMBODIMENT

Figure 1:
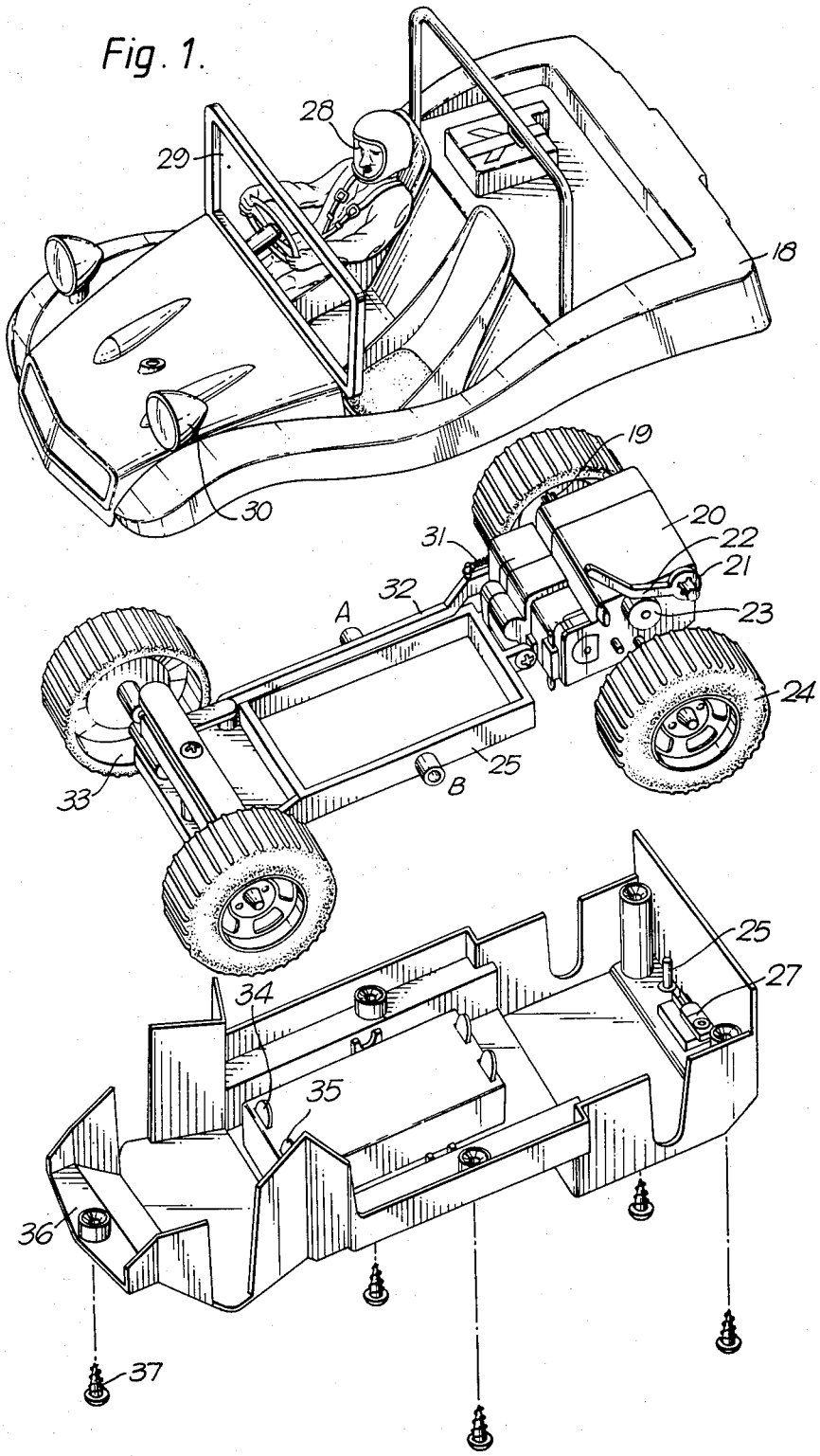
FIG. 1 shows a perspective view of a toy motor car in accordance with the present invention during a stage in the manufacture thereof.

Referring now to the drawings, there is shown a toy motor car comprising a body 18, a frame 25 and a bottom cover 36. In order to complete manufacture of the toy motor car, the body 18 is secured to the bottom cover 36 by means of screws 37 so that the body 18 and the bottom cover 36 are pivotally supported by the frame 25 about the line A-B. The frame 25 is provided with two back wheels 24 and two front wheels 33 rotatably mounted thereon. The frame 25 is also provided with a gear box 20 fixedly mounted thereon, the gear box 20 having disposed therein a DC motor 2 for driving the back wheels 24 in rotation and for effecting turning of the front wheels 33 and pivotal movement of the body 18 and the bottom cover 36 relative to the frame 25, as will be described in more detail hereinafter. Because the motor 2 is supported by the frame 25, and the body 18 and bottom cover 36 are pivotally supported by the frame 25 about a line which is at a distance from the motor 2, the force which must be exerted by means of the motor 2 to cause pivotal movement of the body 18 and bottom cover 36 is relatively small and thus the motor 2 can be small. The bottom cover 36 is provided with battery terminals 34 and 35 and a switch 27 so that batteries may be placed in the bottom cover 36 for powering the motor 2 when the switch 27 is in the "on" position. The batteries may also be used to power headlamps 30 of the toy motor car.

The gear box 20 comprises a casing 1, an inner plate 12 and a cover 9 which is secured to the casing 1 by means of screws 8. The motor 2 is disposed in the casing 1. In use, rotational motion is transmitted from the motor 2 to a shaft 7 via a pinion 3, which is fixedly mounted on a shaft of the motor 2, gear wheels 10 and 11, which are slidably and rotatably mounted on shafts 7 and 15 respectively, and a gear wheel 6, which is fixedly mounted on the shaft 7. The shaft 15 is slidably and rotatably inserted through holes formed in the casing 1, the inner plate 12 and the cover 9. The shaft 15 is provided with a clutch comprising a gear wheel 13, which is slidably and rotatably mounted on the shaft 15, and a gear wheel 14, which is fixedly mounted on the shaft 15 and provided with inclined flanges adapted to engage with corresponding flanges formed on the gear wheel 13. In the embodiment illustrated, the gear ratio between the gear wheels 13 and 14 is 36:35. The clutch is disposed inside the gear box casing 1 and is maintained in contact with the inner plate 12 by means of a helical compression spring 16 through which the shaft 15 is slidably inserted. A rear axle 5 of the toy motor car is rotatably inserted through holes formed in the casing 1, the inner plate 12 and the cover 9, and is provided with a pinion 4 fixedly mounted thereon. A back wheel 24 is fixedly mounted at each end of the rear axle 5. Also, a pinion 17 is rotatably mounted within the inner casing 1.

Thus, when the switch 27 is in the "on" position, power is transmitted to the motor 2 which effects rotation of the shaft 7. The rotational movement is transmitted to the shaft 15 by engagement between the gear wheel 6 and the gear wheels 13 and 14. In a first position of the shaft 15, wherein the spring 16 is slightly compressed and the gear wheels 13 and 14 are spaced apart by a minimum distance determined by the depth of the flanges thereon, the gear wheel 14 engages with the pinion 4, thereby effecting rotation of the rear axle 5 and thus of the back wheels 24. The toy motor car thus travels in a forward direction. During such motion, the pinion 17 is engaged only by the pinion 4 and is rotatable thereby. Because of the differing speeds of rotation of the gear wheels 13 and 14, interaction between the inclined flanges thereon causes the gear wheel 14, and thus the shaft 15, to be pushed axially against the biassing action of the spring 16. The gear wheel 14, therefore, moves out of contact with the pinion 4 so that the rear axle is no longer driven directly thereby. Instead, rotational movement is transmitted from the gear wheel 14 to the pinion 4 via the pinion 17, with which the gear wheel 14 now meshes. Thus, the direction of rotation of the rear axle is reversed and the toy motor car travels in a reverse direction. When the shaft 15 has reached a second position thereof wherein the spring 16 is compressed to a maximum extent and the distance between the gear wheels 13 and 14 has reached a maximum value equal to twice the depth of the flanges thereon, the flanges on the respective gear wheels 13 and 14 are able to slide over one another and the shaft 15 snaps back to the first position thereof in response to the restoring action of the spring 16. Thus, the toy motor car can move forwards and in reverse at predetermined intervals.

Figure 2:
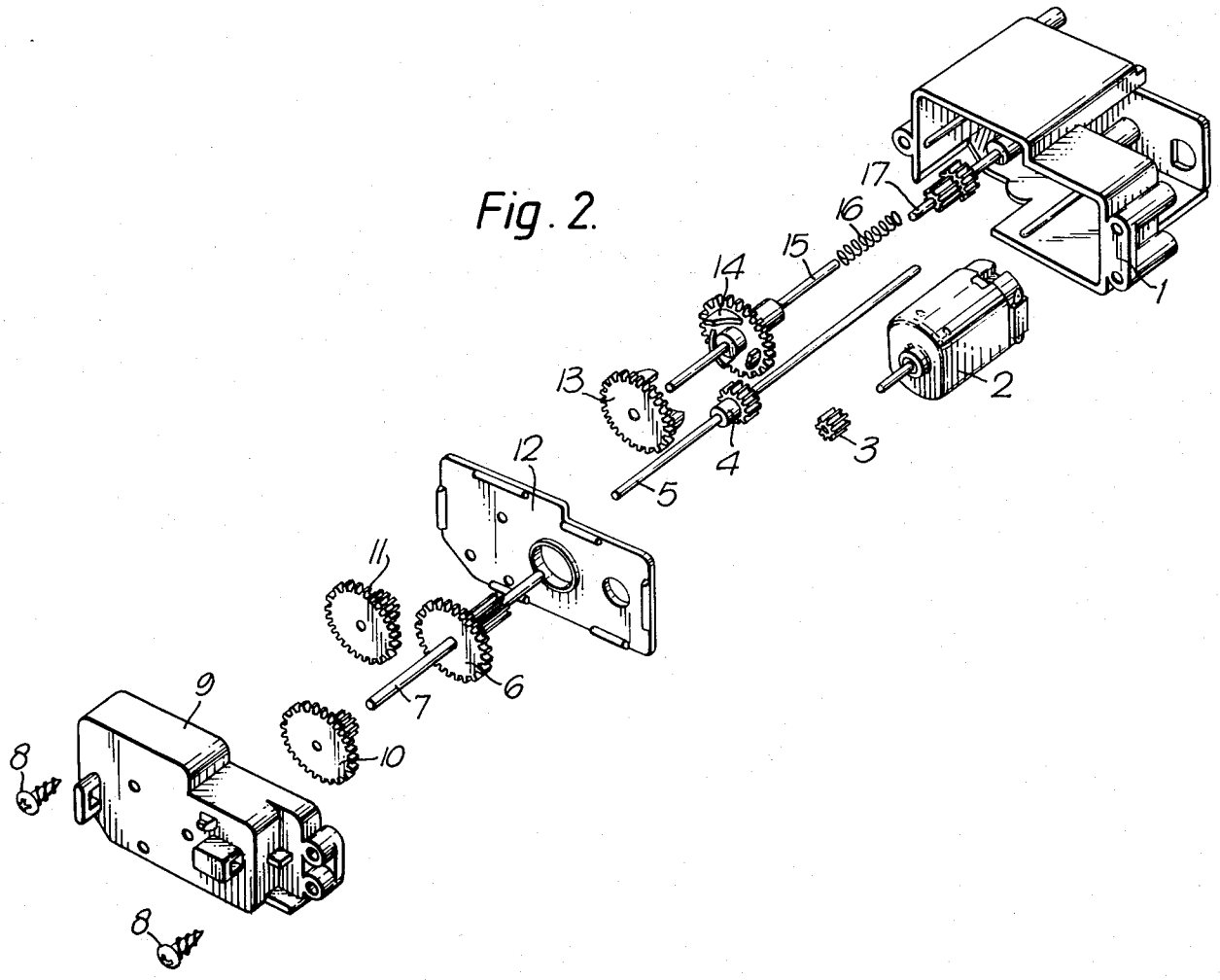
FIG. 2 shows an exploded perspective view of a gear box of the toy motor car of FIG. 1.

Disposed at either end of the shaft 15 and outside the gear box 20 are a pinion 19 and a cam 23 (not shown in FIG. 2). The pinion 19 is fixedly mounted on the shaft 15 and is adapted to engage a rack of a lever 32 for turning the front wheels 33. The cam 23 is fixedly and eccentrically mounted on the shaft 15. A cam follower 22 is pivotally secured to the outside of the gear box 20 by means of a washer 21. When the shaft 15 is in the first position thereof the rotating cam contacts the cam follower which moves up and down in response to push the body 18 vertically at intervals. Thus, when the toy motor car is moving in the forward direction the body 18 and bottom cover 36 rock pivotally on the frame 25 to imitate the movements of a car travelling over undulating sand. During such movement the pinion 19 does not engage the lever 32. As the shaft 15 moves from the first position to the second position thereof, and the gear wheel 14 is thus disengaged from the pinion 4 and engages the pinion 17, thereby reversing the motion of the toy motor car, the cam 23 moves out of contact with the cam follower 22 and the pinion 19 engages the rack of the lever 32 thereby turning the front wheels 33. Thus, the toy motor car reverses and turns at the same time. When the shaft 15 snaps back to the first position thereof, and the pinion 19 is thus disengaged from the lever 32, the front wheels 33 are restored to their forward facing orientation by means of a tension spring 31.

Thus, the present invention enables the provision of a toy motor car which can travel forwards whilst exhibiting a rocking motion and backwards whilst turning, and can change direction at predetermined intervals.

Although particular embodiments of the Invention have been described and illustrated herein, it is recognised that modifications may readily occur to those skilled in the art and consequently it is intended that the following claims be interpreted to cover such modifications and equivalents.

What is claimed is:

1. a toy vehicle, which comprises a frame, a body, the body being pivotally mounted on the frame, and means for effecting movement of the vehicle and for effecting pivotal movement of the body relative to the frame, wherein the movement effecting means comprises a shaft rotatably and slidably mounted relative to the frame, a clutch for effecting axial movement of the shaft from a first axial position thereof to a second axial position thereof, the clutch comprising a first gear wheel fixedly mounted on the shaft, inclined flanges provided on the first gear wheel, a second gear wheel slidably and rotatably mounted on the shaft and inclined flanges provided on the second gear wheel and adapted to cooperate with the inclined flanges of the first gear wheel, the gear ratio between the first and second gear wheels being other than one, means for restoring the shaft to the first position thereof, an electrically powerable motor fixed on the frame, a gear means for simultaneously engaging and driving the first and second gear wheels, the gear means being rotatably mounted with respect to the frame and rotatable by means of the electrically powerable motor, and a further gear means for engaging the first gear wheel when the shaft is in the second axial position thereof and wherein the toy vehicle further comprises a first wheel axle rotatably mounted to the frame, a wheel fixed to each of two ends of the first wheel axle and a pinion for engaging the first gear wheel when the shaft is in the first axial position thereof, wherein the pinion engages the further gear means at all times and is fixed to the said first wheel axle.

2. A toy vehicle according to claim 1 which further comprises an eccentric cam fixed on the shaft and a cam follower for engaging the eccentric cam when the shaft is in the first axial position thereof, the cam follower being pivotally mounted with respect to the frame and arranged to contact the body and to effect pivotal movement of the body.

3. A toy vehicle according to claim 1 which further comprises a pinion fixed on the shaft, a lever, a rack provided on the lever for engaging the said pinion, which is fixed on the shaft, when the shaft is in the second axial position thereof, a second wheel axle rotatably mounted on the frame, a wheel fixed to each of two ends of the second wheel axle, the second wheel axle being turnable with respect to the frame between a first position in which the first and second wheel axles are parallel and a second position in which the first and second wheel axles are not parallel and the lever being connected to the second wheel axle for turning the same to the second position thereof, and restoring means for restoring the second wheel axle to the first position thereof when the shaft is in the first axial position thereof.

4. A toy vehicle according to claim 1, wherein the movement effecting means comprises means for effecting pivotal movement of the body relative to the frame when the shaft is in the first axial position thereof and means for effecting turning of the vehicle when the shaft is in the second axial position thereof.

5. A toy vehicle, which comprises a frame, a body pivotally mounted on the frame, a bottom cover for the body, a plurality of screws securing the bottom cover to the body, a first wheel axle rotatably mounted on the frame, a wheel fixed to each of two ends of the first wheel axle, a second wheel axle rotatably mounted on the frame, a wheel fixed to each of the two ends of the second wheel axle, the second wheel axle being turnable with respect to the frame between a first position in which the first and second wheel axles are parallel and a second position in which the first and second wheel axles are not parallel, a gear box, through which the first wheel axle rotatably extends, fixed to the frame, an electrically powerable motor housed in the gear box, a shaft extending slidably and rotatably through the gear box, a clutch disposed in the gear box for effecting axial movement of the shaft from a first axial position thereof to a second axial position thereof, the clutch comprising a first gear wheel fixedly mounted on the shaft, inclined flanges provided on the first gear wheel, a second gear wheel slidably and rotatably mounted on the shaft and inclined flanges provided on the second gear wheel and adapted to cooperate with the inclined flanges of the first gear wheel, the gear ratio between the first and second gear wheels being other than one, means provided in the gear box for restoring the shaft to the first axial position thereof, a gear means for simultaneously engaging and driving the first and second gear wheels, the gear means being disposed in the gear box and drivable in rotation by the electrically powerable motor, further gear means rotatably mounted in the gear box for engaging the first gear wheel when the shaft is in the second axial position thereof, a first pinion disposed in the gear box for engaging the first gear wheel when the shaft is in the first axial position thereof, wherein the first pinion engages the further gear means at all times and is fixed to the first wheel axle, an eccentric cam fixed to one end of the shaft and disposed outside the gear box, a cam follower for engaging the eccentric cam when the shaft is in the first axial position thereof, the cam follower being vertically pivotally secured to an exterior surface portion of the gear box and arranged to contact the body and to effect vertical pivotal movement of the body, a second pinion fixed to the other end of the shaft and disposed outside the gear box, a lever, a rack provided on the lever for engaging the said second pinion when the shaft is in the second axial position thereof, the lever being connected to the second wheel axle for turning the same to the second position thereof, and restoring means connecting the lever to the frame for restoring the second wheel axle to the first position thereof when the shaft is in the first axial position thereof.

* * * * *